US007120941B2

(12) United States Patent
Glaser

(10) Patent No.: US 7,120,941 B2
(45) Date of Patent: Oct. 17, 2006

(54) CRASH HELMET ASSEMBLY

(76) Inventor: Ken Glaser, 7355 E. Calle Granada, Anaheim, CA (US) 92808

( * ) Notice: Subject to any disclaimer, the term of this patent is extended or adjusted under 35 U.S.C. 154(b) by 75 days.

(21) Appl. No.: 10/981,470

(22) Filed: Nov. 5, 2004

(65) Prior Publication Data

US 2006/0096010 A1 May 11, 2006

(51) Int. Cl.
*A42B 1/08* (2006.01)

(52) U.S. Cl. ..... 2/424; 2/425

(58) Field of Classification Search ..... 2/9, 2/424, 425, 468; 602/17, 18, 20; 128/857, 128/869

See application file for complete search history.

(56) References Cited

U.S. PATENT DOCUMENTS 1,163,247 A 12/1915 McGrew
2,682,235 A 1/1954 Fuller
3,134,106 A * 5/1964 Shaffer et al. ..... 2/462
3,879,761 A 4/1975 Bothwell
3,991,421 A 11/1976 Stratten
4,999,855 A * 3/1991 Brown ..... 2/421
5,261,125 A 11/1993 Cartwright et al.
5,295,271 A * 3/1994 Butterfield et al. ..... 2/410
5,353,437 A 10/1994 Field et al.
5,493,736 A * 2/1996 Allison ..... 2/416
5,517,699 A * 5/1996 Abraham, II ..... 2/425
5,566,399 A * 10/1996 Cartwright et al. ..... 2/421
5,581,816 A * 12/1996 Davis ..... 2/416
5,715,541 A 2/1998 Landau
6,052,835 A * 4/2000 O'Shea ..... 2/468
6,292,954 B1 * 9/2001 O'Bradaigh et al. ..... 2/424
6,385,781 B1 5/2002 Rose et al.
6,588,022 B1 7/2003 Anders et al.
6,763,524 B1 * 7/2004 Halstead et al. ..... 2/9

* cited by examiner

*Primary Examiner*—Rodney Lindsey
(74) *Attorney, Agent, or Firm*—Jacobson Holman PLLC

(57) ABSTRACT

A crash helmet assembly is provided including a lightweight shell or lattice of sufficiently rigid material and geometric design to surround but not contact the user's head. The helmet is affixed to a rigid vest-like garment by interconnecting rigid straps and braces such that the resulting combination deflects compression impact forces away from the head and neck and onto the user's shoulders and upper torso.

16 Claims, 4 Drawing Sheets

CRASH HELMET ASSEMBLY

FIELD OF THE INVENTION

The present invention relates to a crash helmet assembly for protecting the head and neck of a wearer by transferring impact forces to the shoulders and upper torso of the wearer.

BACKGROUND OF THE INVENTION

Ten percent of all spinal injuries occur during sports; primarily during the sports of diving, surfing and football. Traditional close-fitting motorcycle or bicycle-style protective helmets are used amongst only nine percent of surfers.

Even though traditional crash helmets are at least 50 percent effective in reducing head and neck injuries among motorcyclists, including injuries that result in paralysis or death, motorcyclists do not uniformly choose to wear traditional crash helmets in states that do not have mandatory helmet laws. Some motorcyclists in states with mandatory helmet laws attempt to effect repeal of helmet laws due to the perceived restrictiveness of the use of such helmets.

SUMMARY OF THE INVENTION

A crash helmet assembly according to the present invention includes a lightweight shell or lattice of sufficiently rigid material and geometric design to surround but not contact the user's head. The helmet is affixed to a rigid vest-like garment by interconnecting rigid straps and braces such that the resulting combination deflects compression impact forces away from the head and neck and onto the user's shoulders and upper torso.

This rigid structure provides some protection to the head from blunt trauma and provides some protection to the neck and spinal column from injurious compression forces. The assembly also offers some abrasion resistance similar to a traditional crash helmet. In effect, the assembly serves as a miniature, body-mounted, head-protecting, spherical roll bar to help protect the wearer from head and neck injuries in certain circumstances.

The assembly can be used in most situations where a typical crash helmet would be useful, including motorcycling, bicycling, horseback riding, surfing and other high-risk sports. The assembly is especially useful in minimizing or eliminating neck compression injuries, which is a common cause of spinal cord injury among surfers. In a typical surfing accident, the surfer is pushed by a wave headfirst into the sand in shallow water. Unlike a traditional crash helmet, the assembly of the present invention prevents the type of neck compression that results from head contact with the sand or with a surfboard by spacing the head from the point of impact.

The present invention exceeds the protective capability of traditional motorcycle-style crash helmets in certain circumstances. Although a traditional helmet can protect the head itself from injury, by:

(a) absorbing some of the impact energy that would impart an unacceptable acceleration to the brain within the skull, through use of a cushioned liner typically made of polystyrene padding, and (b) serving as a barrier against an object's intrusion into the skull through use of a hard plastic shell;

the user's spinal column is still vulnerable to forces transmitted through the head/helmet unit into the neck. The assembly of the present invention deflects compression impact forces away from the head and neck and onto the user's shoulders and upper torso, which can better withstand such injurious forces.

The present invention is designed to address some of the reasons that consumers give for rejecting traditional motorcycle-style crash helmets:

(a) whereas users of traditional helmets may feel claustrophobic or otherwise uncomfortable because of the necessity to have a snug fit to provide adequate protection, the helmet of the present invention does not touch the head;

(b) whereas users of traditional helmets may feel that the weight of traditional crash helmets limit head and neck mobility, the helmet of the present invention does not mount in contact with the head and therefore maximizes freedom of head movement;

(c) whereas users of traditional helmets may feel that traditional crash helmets unduly restrict peripheral vision, the helmet of the present invention is manufactured in an open lattice design without reducing crash effectiveness; and (d) whereas users of traditional helmets may feel that traditional crash helmets are unhygienic because of the intimate contact between the helmet's interior and the user's head, the helmet of the present invention does not require a cushioned liner in contact with the head for protection.

In a preferred embodiment the protective exo-skeleton style helmet of the present invention provides a strong lattice construction incorporating the structural advantages realized by Richard Buckminster Fuller in U.S. Pat. No. 2,682,235, hereby incorporated in its entirety by reference, to maximize the comfort of an open structure. A geodesic dome/sphere shape of the helmet is such an inherently strong design, due to its reliance on triangular bracing, that thin and lightweight material such as titanium or carbon fiber rods comprise a structure rigid enough to withstand high impact/crash forces.

By the use of a rigid vest on which the exo-helmet is mounted, the upper torso and the wearer's shoulders take the bulk of the force of impacts directed toward the top of the head. This is accomplished by having reinforced shoulder areas integral with a vest connected to the exo-helmet. The vest has a close-fitting interior surface to maximize dispersion of axial and lateral forces about the shoulders and upper torso of the wearer, and rigid exterior construction to provide an adequate mounting surface and rigid straps for securely attaching the exo-helmet to the vest.

Accordingly, it is an object of the present invention to provide an unrestrictive crash helmet assembly which transfers impact forces to the shoulders and upper torso of a wearer.

It is another object of the present invention to provide an unrestrictive crash helmet assembly which transfers impact forces to the shoulders and upper torso of a wearer with the helmet being formed of an open-lattice geodesic sphere.

It is still yet another object of the present invention to provide an unrestrictive crash helmet assembly which transfers impact forces to the shoulders and upper torso of a wearer with the helmet being formed of an open-lattice geodesic sphere having rigid straps interconnected between the dome and a vest of the wearer.

It is still yet another object of the present invention to provide an unrestrictive crash helmet assembly which transfers impact forces to the shoulders and upper torso of a wearer with the helmet being formed of an open-lattice geodesic sphere having rigid straps interconnected between the dome and a vest of the wearer with the vest being rigid and supporting the sphere around the head for complete freedom of movement.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
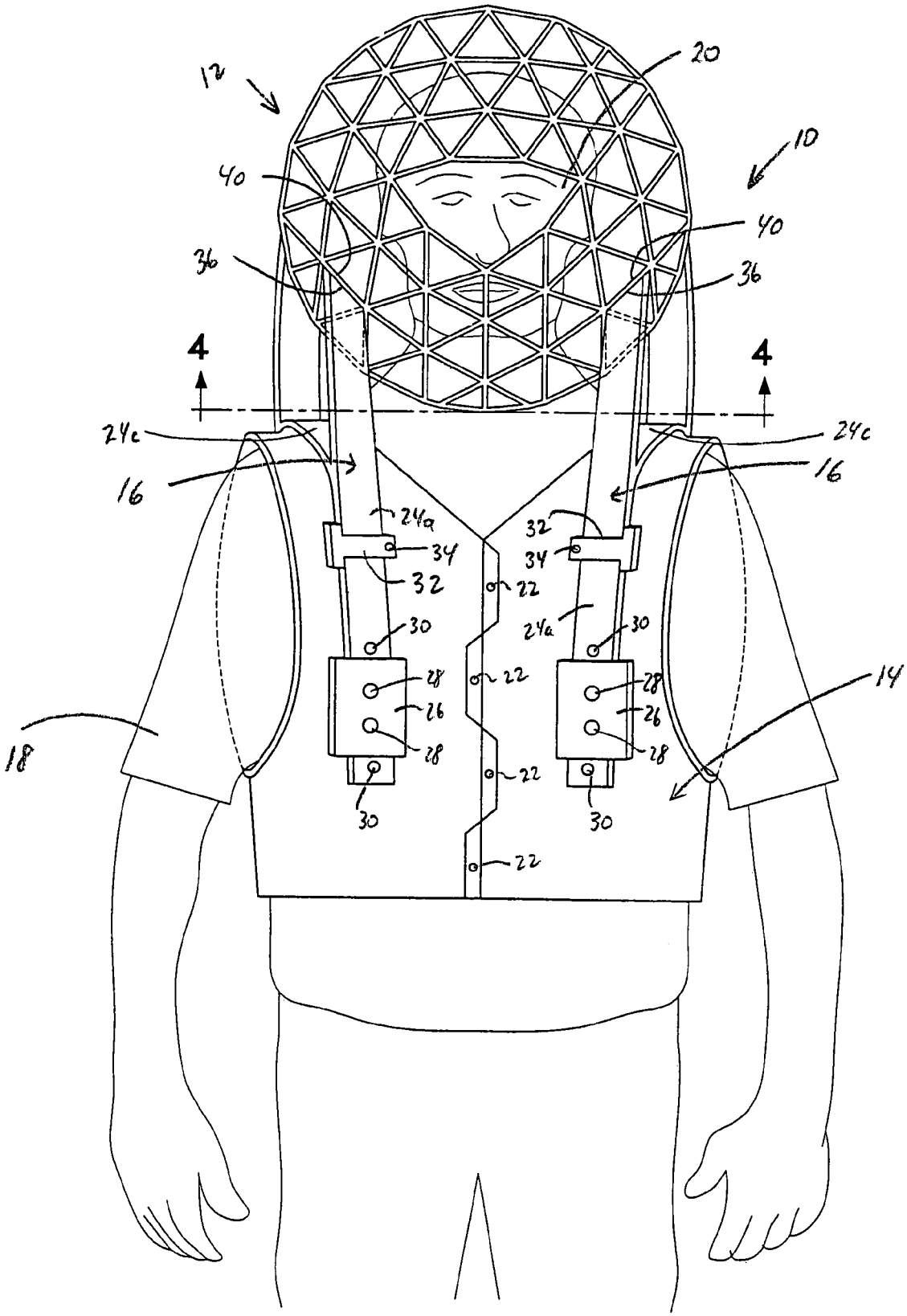
FIG. 1 is a front view of the crash helmet assembly of the present invention shown being worn by a sports enthusiast for spinal column protection while maintaining freedom of movement.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general, and to FIG. 1 in particular, a crash helmet assembly embodying the teachings of the subject invention is generally designated as 10. With reference to its orientation in FIG. 1, the crash helmet assembly includes a helmet 12, a rigid vest 14 and two rigid strap assemblies 16.

In FIG. 1, the assembly 10 is shown worn by a sports enthusiast 18. As shown, there is a spacing of approximately 2 to 4 inches between all surfaces of the head of the wearer and the interior of the geodesic dome helmet 12. This provides ample room for flexing and movement of the head in all directions to avoid encumbering the view of the individual. A direct line of sight is provided by a front opening 20 in the helmet 12 so that there is no blocking of the view when looking in a forward direction. In addition, due to the open lattice construction of the helmet, excellent peripheral viewing is obtained.

The rigid vest 14 is made of a semi-rigid plastic, reinforced material. The vest is worn snugly around the upper torso of the body so as to ensure the positioning and stability of the helmet 12. At a central front position a series of snap-over buttons 22 or a zipper are used to fit the sides of the vest together and secure the vest to the wearer.

Each of the rigid strap assemblies 16 are formed in an H-configuration. Each of the strap portions 24*a*, in the front, and strap portions 24*b*, in the back, are interconnected by a curved central portion 24*c* which overlies the shoulders of an individual and are secured to the vest.

Figure 2:
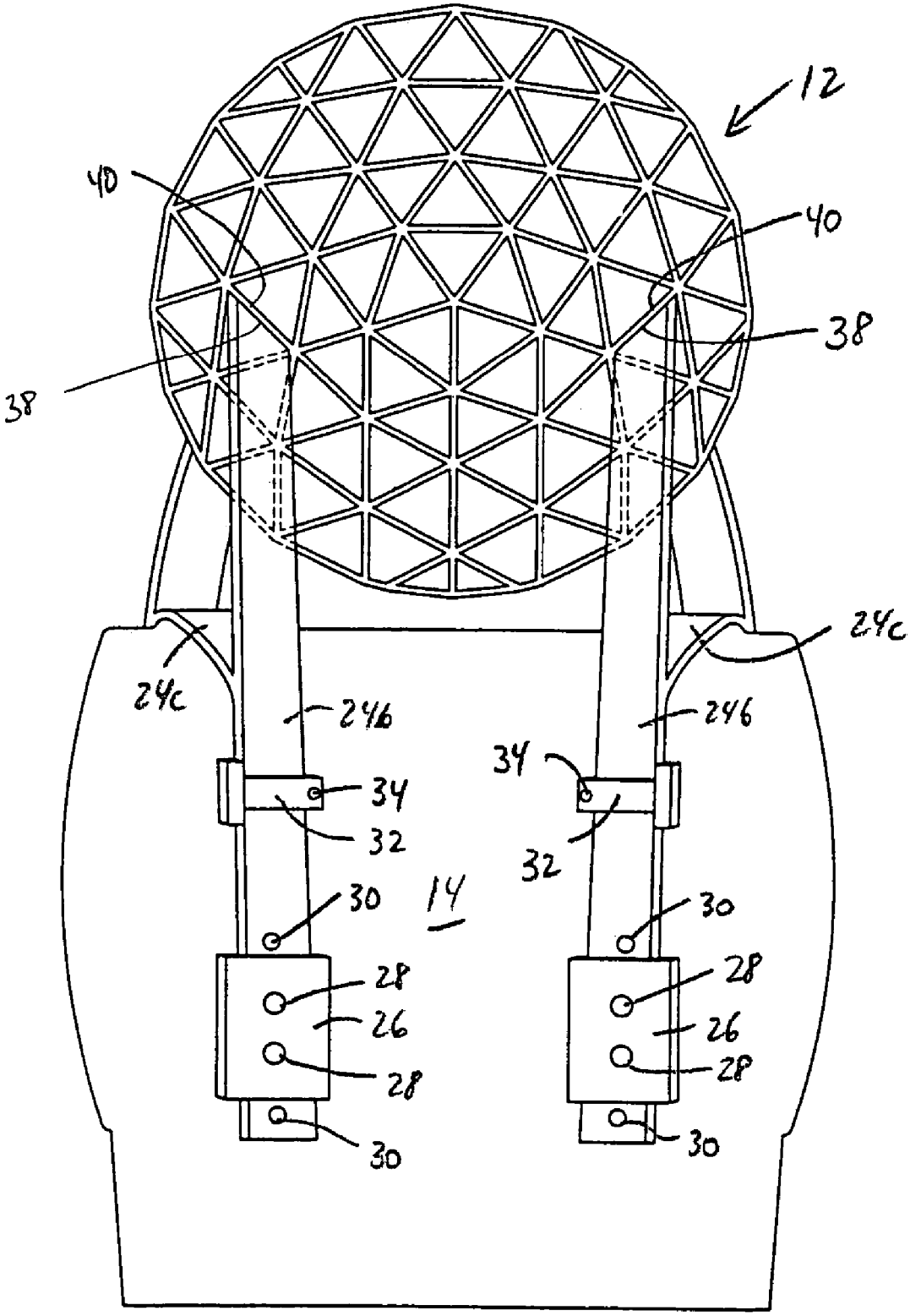
FIG. 2 is a rear view of the crash helmet assembly.
Figure 3:
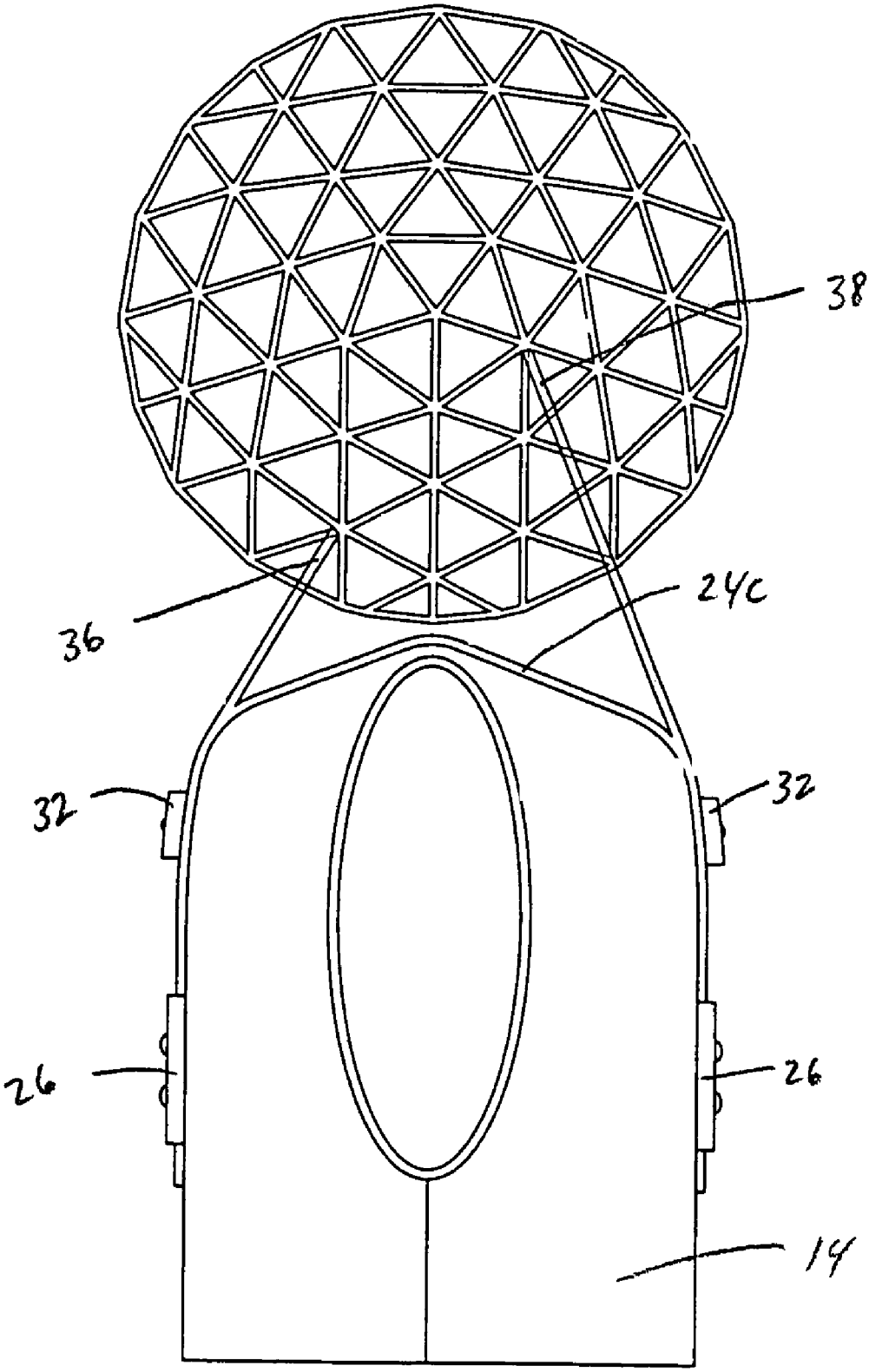
FIG. 3 is a side view of the crash helmet assembly.

The front strap portions 24*a* are anchored in buckles 26 by passage of pins 28 into selected openings 30 of the strap portions 24*a*. An upward extension of the strap portions 24*a* from the buckles 26 pass through a guide buckle 32 which is releasably secured by rivets 34 to allow sliding adjustment of the front strap portions 24*a*. On the rear of the vest 14, as shown in FIG. 2, a similar arrangement is disclosed for the rear strap portions 24*b*.

In a preferred embodiment the portions of the strap assemblies located below the central portions 24*c* fit snugly on top of the vest and are of a steel or rigid plastic configuration. The strap assemblies 16 transfer shock forces applied to the helmet 12 to the shoulders and upper torso of the individual wearing the vest 14.

Upper ends 36, 38 of the straps of the strap assemblies are located at upper end portions of the front and rear strap portions 24*a*, 24*b*, respectively. These terminal end portions are molded into, secured to, riveted or bonded to crossbars 40 of the helmet 12. The upper ends of the strap assemblies above the central portions at the rear of the vest are longer than the upper ends of the strap assemblies above the central portions at the front of the vest. This interconnection directly transfers forces from the helmet to the vest through the strap assemblies.

Figure 4:
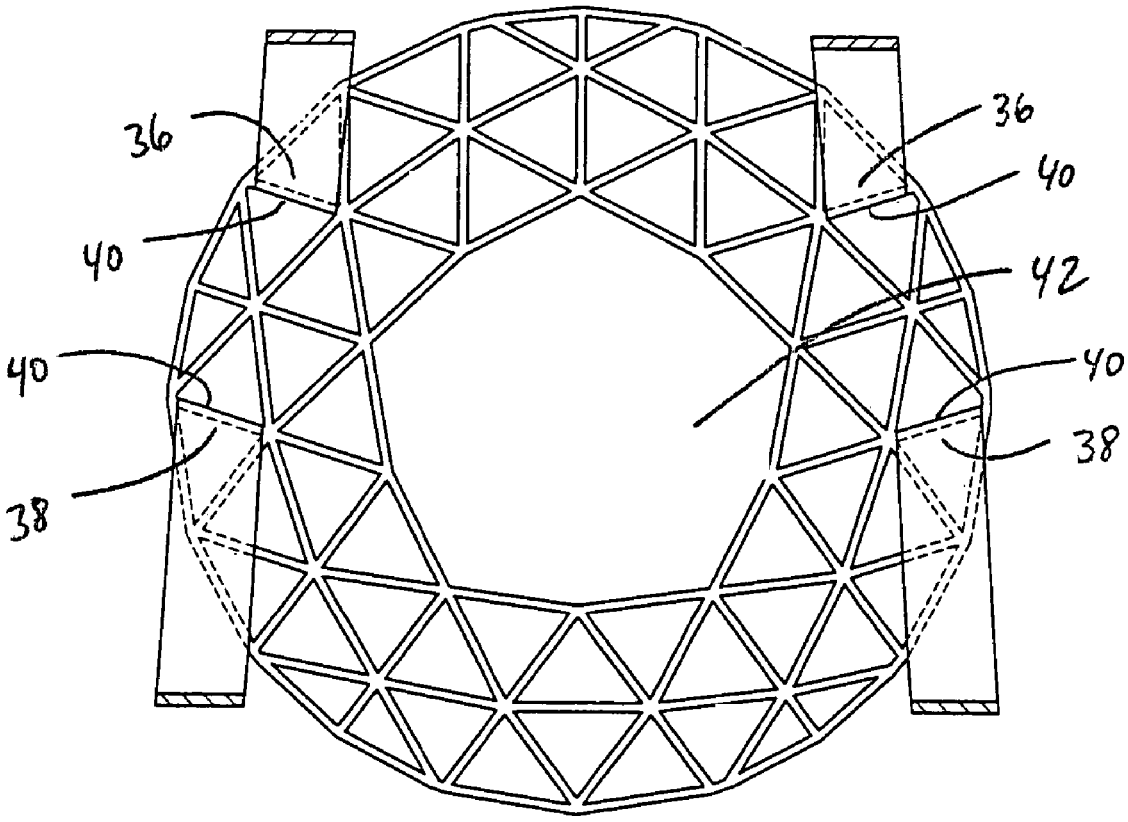
FIG. 4 is a sectional view taken along line 4—4 of FIG. 1.

Multiple crossbars 40 are interconnected in a geodesic triangular pattern to form the helmet 12. The crossbars have a diameter of between ⅛ and ⅜ of an inch. Opening 20 in front of the face of the wearer and opening 42, as shown in FIG. 4, for insertion of the head of the wearer are provided in the helmet.

The interconnection of the various crossbars or rods 40 in a geodesic pattern forms a globe-like configuration around the head of a wearer. The helmet may have a diameter of 12 to 18 inches, dependent on the size of the wearer so as to provide two to four inches of clearance between the head and the helmet. This provides protection against impact forces by transferring force through the strap assemblies 16 to the shoulders and upper torso of the wearer.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. A helmet assembly for transferring impact forces to the shoulders and upper torso of an individual, said helmet assembly comprising an open-lattice geodesic sphere helmet formed of a plurality of interconnected rods in open triangular configurations, a boundary defined by the sphere having at least a majority formed by said open triangular configurations and the helmet being spaced from the head of the individual, a garment to be worn on an upper torso of an individual, and strap assemblies interconnecting the helmet and the garment, the strap assemblies supporting the helmet above the garment.

2. The helmet assembly as claimed in claim 1, wherein the helmet includes a front opening for viewing therethrough by an individual.

3. The helmet assembly as claimed in claim 2, wherein the helmet includes a bottom opening for passage therethrough of a head of the individual.

4. The helmet assembly as claimed in claim 1, wherein the garment is a rigid vest.

5. The helmet assembly as claimed in claim 4, wherein the strap assemblies are secured to the vest and to the helmet.

6. The helmet assembly as claimed in claim 5, wherein the strap assemblies include a portion extending across the shoulders of the vest.

7. The helmet assembly as claimed in claim 6, wherein the strap assemblies are adjustably secured to a front and a rear of the vest.

8. The helmet assembly as claimed in claim 7, wherein an upper extension of the strap assemblies is longer at the rear of the vest than an upper extension of the strap assemblies at the front of the vest.

9. A helmet assembly for transferring impact forces to the shoulders and upper torso of an individual, said helmet assembly comprising an open-lattice geodesic sphere helmet formed of a plurality of interconnected rods in open triangular configurations, a boundary defined by the sphere having at least a majority formed by said open triangular configurations and the helmet being spaced from the head of the individual, a rigid garment to be worn on an upper torso of an individual, and strap assemblies interconnecting the helmet and the rigid garment, the strap assemblies supporting the helmet above the rigid garment.

10. The helmet assembly as claimed in claim 9, wherein the garment is a rigid vest.

11. The helmet assembly as claimed in claim 10, wherein the strap assemblies are secured to the rigid vest and to the helmet.

12. The helmet assembly as claimed in claim 11, wherein the strap assemblies include a portion extending across the shoulders of the rigid vest.

13. The helmet assembly as claimed in claim 12, wherein the strap assemblies are adjustably secured to a front and a rear of the rigid vest.

14. The helmet assembly as claimed in claim 13, wherein an upper extension of the strap assemblies is longer at the rear of the rigid vest than an upper extension of the strap assemblies at the front of the rigid vest.

15. The helmet assembly as claimed in claim 9, wherein the rods are titanium rods.

16. The helmet assembly as claimed in claim 9, wherein the rods are carbon fiber rods.

* * * * *